US011525306B2

(12) United States Patent
Kronman

(10) Patent No.: US 11,525,306 B2
(45) Date of Patent: Dec. 13, 2022

(54) PULSED-POWER DRILL BIT GROUND RING WITH TWO PORTIONS

(71) Applicant: Halliburton Energy Services, Inc., Houston, TX (US)

(72) Inventor: Jacob H. Kronman, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 10 days.

(21) Appl. No.: 16/840,991

(22) Filed: Apr. 6, 2020

(65) Prior Publication Data

US 2021/0310310 A1 Oct. 7, 2021

(51) Int. Cl.
*E21B 7/15* (2006.01)

(52) U.S. Cl.
CPC ..... *E21B 7/15* (2013.01)

(58) Field of Classification Search
CPC ..... E21B 7/15; E21B 10/00
See application file for complete search history.

(56) References Cited

U.S. PATENT DOCUMENTS 9,976,352 B2 5/2018 Fraser et al.
2009/0133929 A1* 5/2009 Rodland ..... E21B 10/60 175/16
2013/0032406 A1* 2/2013 Comeaux ..... E21C 37/18 175/57
2013/0112482 A1 5/2013 Armistead et al.
2014/0367502 A1* 12/2014 Moeny ..... E21B 21/02 241/46.01
2016/0017663 A1* 1/2016 Moeny ..... E21B 17/003 175/327
2017/0204668 A1 7/2017 Lehr
(Continued)

FOREIGN PATENT DOCUMENTS

WO 2006/023998 3/2006
WO 2012/094676 7/2012
(Continued)

OTHER PUBLICATIONS

PCT Search Report and Written Opinion, International Application No. PCT/US2020/027048, dated Dec. 10, 2020, 11 pages.
(Continued)

*Primary Examiner* — David Carroll
(74) *Attorney, Agent, or Firm* — Delizio, Peacock, Lewin & Guerra

(57) ABSTRACT

A drill bit for downhole pulsed-power drilling is disclosed. A pulse-power drill bit may include a bit body; an electrode coupled to a power source and the bit body; a ground ring coupled to the bit body, the electrode and the ground ring positioned such that an electric field produced by a voltage applied between the ground ring and the electrode is enhanced at a portion of the ground ring proximate to the ground ring; a reinforcement material forming portions of the ground ring; a binder material infiltrated through the reinforcement material to form a composite material and forming a first portion of the ground ring; and an machinable material forming a second portion of the ground ring, wherein the composite material has a first resistance to abrasion greater than a second resistance to abrasion of the machinable material.

20 Claims, 7 Drawing Sheets

(56) References Cited

U.S. PATENT DOCUMENTS

| | | | | |
|---|---|---|---|---|
| 2017/0204669 | A1 | 7/2017 | Lehr et al. | |
| 2018/0148981 | A1 | 5/2018 | Moeny | |
| 2018/0209216 | A1* | 7/2018 | Gilbrech | E21B 7/15 |
| 2018/0209217 | A1 | 7/2018 | Moeny et al. | |
| 2019/0040685 | A1* | 2/2019 | Moeny | E21C 37/18 |

FOREIGN PATENT DOCUMENTS

| | | |
|---|---|---|
| WO | 2014/100255 | 6/2014 |
| WO | 2018/136033 | 7/2018 |
| WO | 2019/245545 | 12/2019 |

OTHER PUBLICATIONS

PCT Search Report and Written Opinion, International Application No. PCT/US2020/027045, dated Dec. 30, 2020, 9 pages.

* cited by examiner

PULSED-POWER DRILL BIT GROUND RING WITH TWO PORTIONS

TECHNICAL FIELD

The present disclosure relates generally to pulsed drilling operations and, more particularly, to the ground ring of a pulsed-power drill bit.

BACKGROUND

Pulsed-power drilling may be used to form wellbores in subterranean rock formations for recovering hydrocarbons, such as oil and gas, from these formations. Electrocrushing drilling uses pulsed-power technology to fracture the rock formation by repeatedly delivering electrical arcs or high-energy shock waves to the rock formation. More specifically, a drill bit of a pulsed-power drilling (PPD) system is excited by a train of high-energy electrical pulses that produce high power discharges through the formation at the distal end of the drill bit. The discharges produced by the high-energy electrical pulses, in turn, fracture part of the formation proximate to the drill bit.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

A pulsed power drill bit includes a ground ring enhanced with hardened, mechanical rock cutting features to facilitate penetration and reduce the tendency for physical hang up on wellbore features during pulsed power drilling. The pulsed power drill bit includes an electrode and a ground ring coupled to a power source used to generate electrical pulses for destroying rock in proximity to the pulsed power drill bit. The electrode and ground ring may have contours designed to enhance, concentrate, or otherwise manage the electric field surrounding the drill bit. The electrode and ground ring may also have fluid flow ports and openings to facilitate the flow of pulsed-power drilling fluid into and out of the drilling field. During a drilling operation, the electric field surrounding the drill bit is such that an arc forms and spans the electrode and the ground ring and penetrates the rock formation. The pulsed-power drilling fluid insulates the components of the drill bit and removes rock cuttings from the drilling field. As such, the drilling process may be dominated by pulsed-power destruction of rock. For even more efficient and reliable drilling, the ground ring of the pulsed power drill bit is enhanced according to aspects of this disclosure, such as by infiltration during manufacture with a hardenable material to form hardened, mechanical rock cutting feature(s) on the periphery. The hardened, mechanical rock cutting features may be used to fracture, shear, cut, or otherwise remove and/or destroy portions of the formation that are not or have not yet been removed via pulsed power mode and that might otherwise impede movement of the drill bit.

In one aspect, the ground ring of the drill bit may be enhanced during manufacture by placing loose reinforcement material into a mold and infiltrating the reinforcement material with a binder material. Such a material may have desirable resistance to abrasion properties, but may not be readily machinable. Abrasion resistance may improve downhole life and performance of portions of the ground ring likely to suffer abrasion. Machining of the ground ring may be desirable, for example, for such applications as formation of holes, threads, and other connections within the ground ring. According, the ground ring may include two portions, a first portion formed from a machinable material to facilitate machining of the ground ring, and a second, distal portion of the ground ring formed from a compositive material containing a reinforcement material. The first portion of the ground ring may be located between the second portion and the bit body.

There are numerous ways in which pulsed-power drill bits may be implemented in a downhole pulsed-power system. Thus, embodiments of the present disclosure and its advantages are best understood by referring to FIGS. 1 through 6, where like numbers are used to indicate like and corresponding parts.

Figure 1:
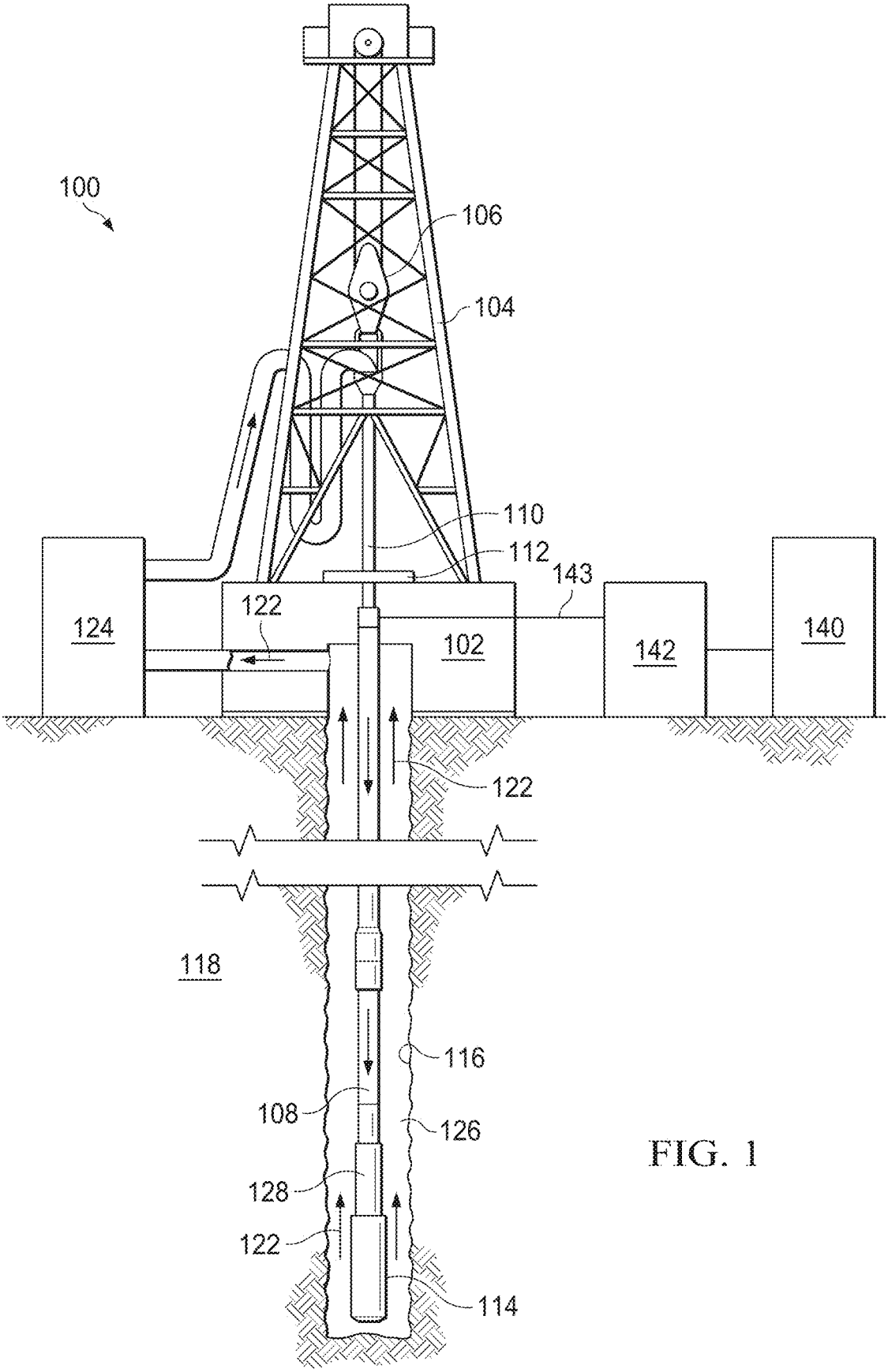
FIG. 1 an elevation view of an example pulsed-power drilling (PPD) system used in a wellbore environment.

FIG. 1 is an elevation view of an exemplary pulsed-power drilling system used to form a wellbore in a subterranean formation. Although FIG. 1 shows land-based equipment, downhole tools incorporating teachings of the present disclosure may be satisfactorily used with equipment located on offshore platforms, drill ships, semi-submersibles, and drilling barges (not expressly shown). Additionally, while wellbore 116 is shown as being a generally vertical wellbore, wellbore 116 may be any orientation including generally horizontal, multilateral, or directional.

Drilling system 100 includes drilling platform 102 that supports derrick 104 having traveling block 106 for raising and lowering drill string 108. Drilling system 100 also includes pump 124, which circulates pulsed-power drilling fluid 122 through a feed pipe to drill string 110, which in turn conveys pulsed-power drilling fluid 122 downhole through interior channels of drill string 108 and through one or more orifices in pulsed-power drill bit 114. Pulsed-power drilling fluid 122 then circulates back to the surface via annulus 126 formed between drill string 108 and the sidewalls of wellbore 116. Fractured portions of the formation are carried to the surface by pulsed-power drilling fluid 122 to remove those fractured portions from wellbore 116.

Pulsed-power drill bit 114 is attached to the distal end of drill string 108. In some embodiments, power to pulsed-power drill bit 114 may be supplied from the surface. For example, generator 140 may generate electrical power and provide that power to power-conditioning unit 142. Power-conditioning unit 142 may then transmit electrical energy downhole via surface cable 143 and a sub-surface cable (not expressly shown in FIG. 1) contained within drill string 108 or attached to the side of drill string 108. A pulse-generating circuit within bottom-hole assembly (BHA) 128 may receive the electrical energy from power-conditioning unit 142, and may generate high-energy pulses to drive pulsed-power drill bit 114.

The pulse-generating circuit within BHA 128 may be utilized to repeatedly apply a high electric potential, for example up to or exceeding 150 kV, across the electrodes of pulsed-power drill bit 114. Each application of electric potential may be referred to as a pulse. When the electric potential across the electrodes of pulsed-power drill bit 114 is increased enough during a pulse to generate a sufficiently high electric field, an electrical arc forms through a rock formation at the bottom of wellbore 116. The arc temporarily forms an electrical coupling between the electrodes of pulsed-power drill bit 114, allowing electric current to flow through the arc inside a portion of the rock formation at the bottom of wellbore 116. The arc greatly increases the temperature and pressure of the portion of the rock formation through which the arc flows and the surrounding formation and materials. The temperature and pressure is sufficiently high to break the rock itself into small bits or cuttings. This fractured rock is removed, typically by pulsed-power drilling fluid 122, which moves the fractured rock away from the electrodes and uphole.

As pulsed-power drill bit 114 repeatedly fractures the rock formation and pulsed-power drilling fluid 122 moves the fractured rock uphole, wellbore 116, which penetrates various subterranean rock formations 118, is created. Wellbore 116 may be any hole drilled into a subterranean formation or series of subterranean formations for the purpose of exploration or extraction of natural resources such as, for example, hydrocarbons, or for the purpose of injection of fluids such as, for example, water, wastewater, brine, or water mixed with other fluids. Additionally, wellbore 116 may be any hole drilled into a subterranean formation or series of subterranean formations for the purpose of geothermal power generation.

Although drilling system 100 is described herein as utilizing pulsed-power drill bit 114, drilling system 100 may also utilize an electrohydraulic drill bit. An electrohydraulic drill bit may have one or more electrodes and ground ring similar to pulsed-power drill bit 114. But, rather than generating an arc within the rock, an electrohydraulic drill bit applies a large electrical potential across the one or more electrodes and ground ring to form an arc across the drilling fluid proximate the bottom of wellbore 116. The high temperature of the arc vaporizes the portion of the fluid immediately surrounding the arc, which in turn generates a high-energy shock wave in the remaining fluid. The one or more electrodes of electrohydraulic drill bit may be oriented such that the shock wave generated by the arc is transmitted toward the bottom of wellbore 116. When the shock wave hits and bounces off of the rock at the bottom of wellbore 116, the rock fractures. Accordingly, drilling system 100 may utilize pulsed-power technology with an electrohydraulic drill bit to drill wellbore 116 in subterranean formation 118 in a similar manner as with pulsed-power drill bit 114.

Figure 2:
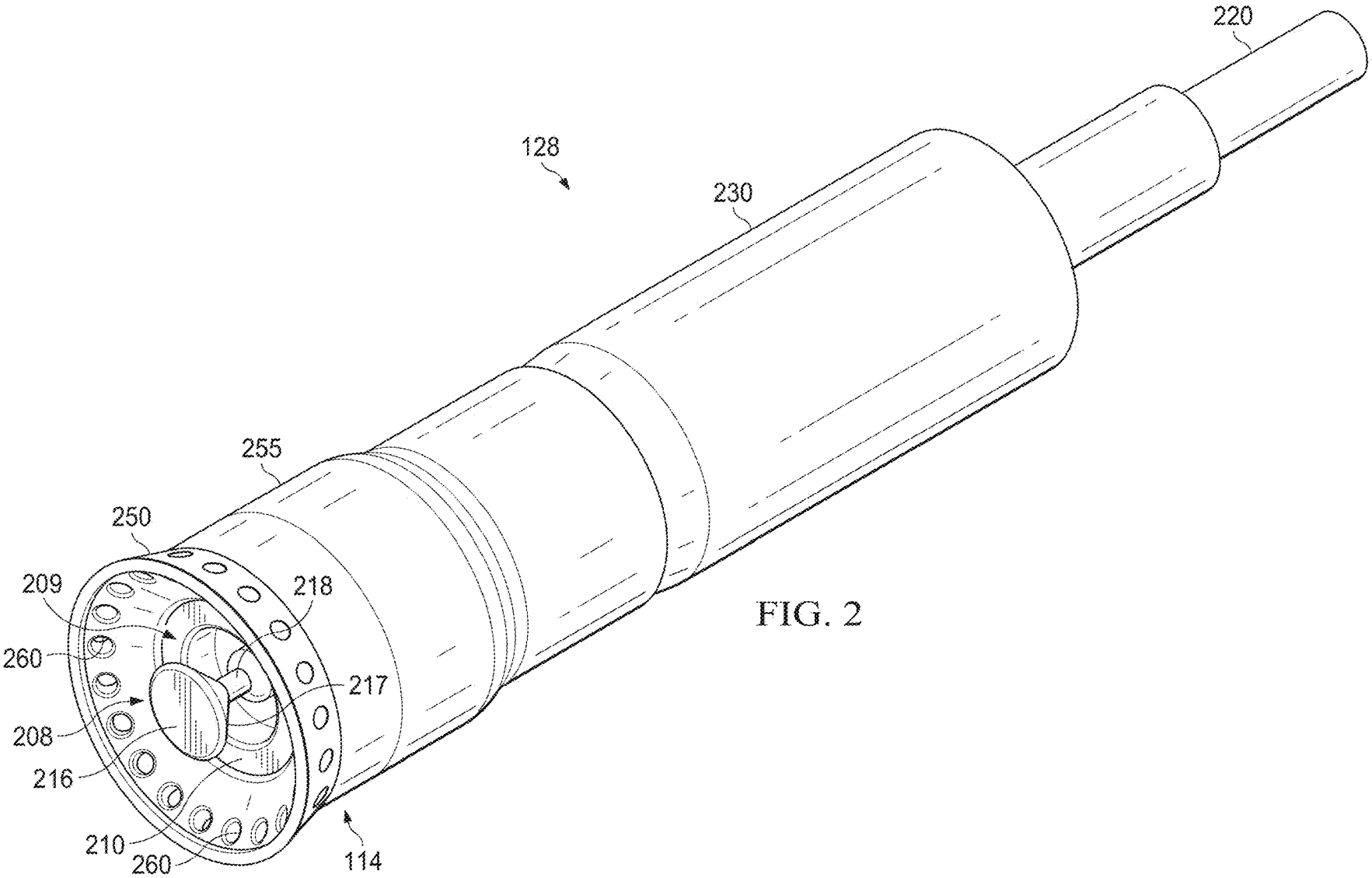
FIG. 2 is a perspective view of example components of a bottom-hole assembly (BHA) for a PPD system.

FIG. 2 is a perspective view of exemplary components of the bottom hole assembly for downhole pulsed-power drilling system 100. Bottom-hole assembly (BHA) 128 may include pulsed-power tool 230. BHA 128 may also include pulsed-power drill bit 114. For the purposes of the present disclosure, pulsed-power drill bit 114 may be integrated within BHA 128, or may be a separate component that is coupled to BHA 128.

Pulsed-power tool 230 may be coupled to provide pulsed electrical energy to pulsed-power drill bit 114. Pulsed-power tool 230 receives electrical power from a power source via cable 220. For example, pulsed-power tool 230 may receive electrical power via cable 220 from a power source on the surface as described above with reference to FIG. 1, or from a power source located downhole such as a generator powered by a mud turbine. Pulsed-power tool 230 may also receive electrical power via a combination of a power source on the surface and a power source located downhole. Pulsed-power tool 230 converts the electrical power received from the power source into high-energy electrical pulses that are applied across electrode 208 and ground ring 250 of pulsed-power drill bit 114.

Referring to FIG. 1 and FIG. 2, pulsed-power drilling fluid 122 may exit drill string 108 via opening 209 surrounding electrode 208. The flow of pulsed-power drill fluid 122 out of opening 209 allows electrode 208 to be insulated by the pulsed-power drilling fluid. While one electrode 208 is shown in FIG. 2, pulsed-power drill bit 114 may include multiple electrodes 208. Pulsed-power drill bit 114 may include solid insulator 210 surrounding electrode 208 and one or more orifices (not expressly shown in FIG. 1 or 2) on the face of pulsed-power drill bit 114 through which pulsed-power drilling fluid 122 exits drill string 108. Such orifices may be simple holes, or they may be nozzles or other shaped features. Because fines are not typically generated during pulsed-power drilling, as opposed to mechanical drilling, pulsed-power drilling fluid 122 may not need to exit the drill bit at as high a pressure as the drilling fluid in mechanical drilling. As a result, nozzles and other features used to increase drilling fluid pressure may not be needed. However, nozzles or other features to increase pulsed-power drilling fluid 122 pressure or to direct pulsed-power drilling fluid may be included for some uses. Additionally, the shape of solid insulator 210 may be selected to enhance the flow of pulsed-power drilling fluid 122 around the components of pulsed-power drill bit 114.

Pulsed-power drilling fluid 122 is typically circulated through drilling system 100 at a flow rate sufficient to remove fractured rock from the vicinity of pulsed-power drill bit 114. In addition, pulsed-power drilling fluid 122 may be under sufficient pressure at a location in wellbore 116, particularly a location near a hydrocarbon, gas, water, or other deposit, to prevent a blowout.

Pulsed-power drill bit 114 may include bit body 255, electrode 208, ground ring 250, and solid insulator 210. Electrode 208 may be placed in the center of pulsed-power drill bit 114. The distance between electrode 208 and ground ring 250 may be a minimum of 0.4 inches and a maximum of 4 inches. The distance between electrode 208 and ground ring 250 may be based on the parameters of the pulsed-power drilling operation. For example, if the distance between electrode 208 and ground ring 250 is too small, pulsed-power drilling fluid 122 may break down and the arc between electrode 208 and ground ring 250 may not pass through the rock. However, if the distance between electrode 208 and ground ring 250 is too large, pulsed-power drilling bit 114 may not have adequate voltage to form an arc through the rock. For example, the distance between electrode 208 and ground ring 250 may be at least 0.4 inches, at least 1 inch, at least 1.5 inches, or at least 2 inches. The distance between electrode 208 and ground ring 250 may be based on the diameter of pulsed-power drill bit 114. The distance between electrode 208 and ground ring 250 may be generally symmetrical or may be asymmetrical such that the electric field surrounding the pulsed-power drill bit has a symmetrical or asymmetrical shape. The distance between electrode 208 and ground ring 250 allows pulsed-power drilling fluid 122 to flow between electrode 208 and ground ring 250 to remove vaporization bubbles from the drilling area. If drilling system 100 experiences vaporization bubbles in pulsed-power drilling fluid 122 near pulsed-power drill bit 114, the vaporization bubbles may have deleterious effects. For instance, vaporization bubbles near electrode 208 may impede formation of the arc in the rock. Pulsed-power drilling fluid 122 may be circulated at a flow rate also sufficient to remove vaporization bubbles from the vicinity of pulsed-power drill bit 114.

Electrode 208 has three sections: face 216, body 217, and stem 218. Face 216 is a distal portion of electrode 208 in contact with the rock during a pulsed-power drilling operation. For example, face 216 may engage with a portion of the wellbore, such as wellbore 116 shown in FIG. 1. Body 217 couples face 216 to stem 218. Stem 218 couples electrode 208 to pulsed-power drill bit 114. Electrode 208 may have any suitable diameter based on the drilling operation. For example, electrode 208 may have a diameter between two and ten inches, inclusive. In some embodiments electrode 208 may be smaller than two inches in diameter, inclusive. The diameter of the electrode may be based on the diameter of pulsed-power drill bit 114 and the distance between electrode 208 and ground ring 250, as described above.

The geometry of electrode 208 affects the electric field surrounding pulsed-power drill bit 114 during pulsed-power drilling. For example, the geometry of electrode 208 may be designed to result in an enhanced electric field surrounding electrode 208 so that the arcs initiate at electrode 208 and terminate on ground ring 250, or vice versa such that the arc initiates from ground ring 250 and terminate on electrode 208. The electric field surrounding electrode 208 may be designed so that most of the arcs initiating between electrode 208 and ground ring 250 do so through a path or multitude of paths that results in more efficient rock removal, for example a path or paths through the rock. Similarly, the electric field surrounding electrode 208 may be designed so as to minimize the arcs initiating between electrode 208 and ground ring 250 that do so through a path or multitude of paths that results in less efficient rock removal, for example path or paths short-cutting through the drilling fluid without penetrating the rock. For example, face 216 of electrode 208 may be engaged with a surface of the wellbore and a distal portion of ground ring 250 may also be engaged with the surface of the wellbore. The electric field may be designed such that the electric field is enhanced at a portion of electrode 208 proximate to face 216 and on a portion of ground ring 250 proximate to the distal portion of ground ring 250. An enhanced electric field in a region surrounding pulsed-power drill bit 114 may result in an increased electric flux in that region. For example, the electric field $E_s$ in the vicinity of a specifically shaped conducting structure will be larger than the average macroscopic electrical field created by the applied voltage over the average spacing $E_{applied}$ by the field enhancement factor, γ, defined by the equation below:

$$\gamma = \frac{E_S}{E_{applied}}$$

The geometry of electrode 208 includes the profile of face 216, the shape of body 217, and contours of transitions between face 216, body 217, and stem 218. For example, face 216 may have a flat profile, a concave profile, or a convex profile. The profile may be based on the design of the electric field surrounding the pulsed-power drill bit. Body 217 may be generally conical shaped, cylindrical shaped, rectangular shaped, polyhedral shaped, tear drop shaped, rod shaped, or any other suitable shape. The transitions between face 216 and body 217 may be contoured to result in electric field conditions that are either favorable or unfavorable for arc initiation or termination. For example, the transition between face 216 and body 217 may have a sharp radius of curvature such that the electric field conditions are favorable for an arc to initiate and/or terminate at the transition between face 216 and body 217. In contrast, the transition between body 217 and stem 218 may have a gentle radius of curvature such that the conditions are not favorable for arc initiation and/or termination at the transition between body 217 and stem 218. A radius of curvature of a transition is the radius of a circle of which the arc of the transition is a part. By way of example, a sharp radius of curvature may be a radius greater than 0.01 inches, and sometimes in the range of 0.05 to 0.15 inches, inclusive, such as 0.094 inches, and a gentle radius of curvature may be a radius in the range of 0.15 to 1.0 inches, inclusive, such as 0.25 inches, 0.5 inches, 0.75 inches, or 1.0 inches. The ratio of the gentle radius of curvature to the sharp radius of curvature may be by 2:1 or more, and may be up to 5:1, 10:1, or greater than 10:1. The gentle radius may be determined based on the geometry of the surrounding structures on pulsed-power drill bit 114 and the shape of the electric field for a given pulsed-power drilling operation. For example, the electric fields on electrode 208 may be a function of the geometry of ground ring 250 and the geometry and material of insulator 210. For example, the radius of the edge of electrode 208 and the shape of electrode 208 may affect the interaction of pulsed-power drill bit 114 with the rock. Additionally, the structure of ground ring 250 may be adjusted to change the electric field distribution on electrode 208. Further, the material used to form insulator 210 and the configuration of insulator 210 may be adjusted to change the electric field on electrode 208. In some examples, the dielectric constant of the pulsed-power drilling fluid and the geometry of the rock fragments and the wellbore during the drilling process may affect the instantaneous electric field distribution on electrode 208. The geometry of pulsed-power drill bit 114, and specifically certain dimensions between electrode 208 and ground ring 250, may be designed to maximize the occurrence of arc paths between the electrode and ground ring which travel through the rock, and/or to minimize short-cut paths for arcs to travel between the electrode and ground ring. Body 217, or body 217 in combination with stem 218, may be shaped to result in a first minimum distance between electrode 208 and ground ring 250, with a substantial portion of the electrode's conductive surface in the axial direction, perpendicular to face 216, being at a greater distance from ground ring 250. The first minimum distance may be a distance less than the average distance between electrode 208 and ground ring 250. The first minimum distance may result in a relative enhancement or concentration of the electric field at the perimeter of face 216 versus the balance of the axial extent of electrode 208, for example such that first minimum distance is at least 15% less than the average distance between electrode 208 and ground ring 250, at least 25% less than the average distance between electrode 208 and ground ring 250, or at least 50% less than the average distance between electrode 208 and ground ring 250. A conical shaped ground ring as shown in FIG. 2 may achieve this criterion, as may a semi-sphere or certain other geometries. For example, in FIG. 2, the first minimum distance may be the distance between the perimeter of face 216 and ground ring 250 while the average distance between electrode 308 and ground ring 250 is calculated including the distance between body 217 and ground ring 250 and stem 218 and ground ring 250. The first minimum distance may be such that the electric field is enhanced or concentrated on a portion of electrode 208 proximate to face 216 and on a portion of ground ring 250 proximate to the distal portion of ground ring 250.

Ground ring 250 may function as an electrode and provide a location on the pulsed-power drill bit where an arc may initiate and/or terminate. Ground ring 250 also provides one or more fluid flow ports 260 such that pulsed-power drilling fluids flow through fluid flow ports 260 carry fractured rock and vaporization bubbles away from the drilling area. Further, ground ring 250 provides structural support for pulsed-power drill bit 114 to support the downforce caused by the weight of the pulsed-power drilling components uphole from pulsed-power drill bit 114, such as drill string 108 shown in FIG. 1. Pulsed-power drill bit 114 may Additionally include an machinable structural component (not expressly shown) that supports the downforce created by the weight of the pulsed-power drilling components uphole from pulsed-power drill bit 114. For example, an insulative ring or studs may be located on pulsed-power drill bit 114 to bear some or all of the weight of the pulsed-power drilling components and the weight of some or all of the drill string. As another example, a structural support structure, physically separated from but coupled to the ground ring electrode, may be used to support the weight of pulsed-power drilling components and drill string.

Figure 3A:
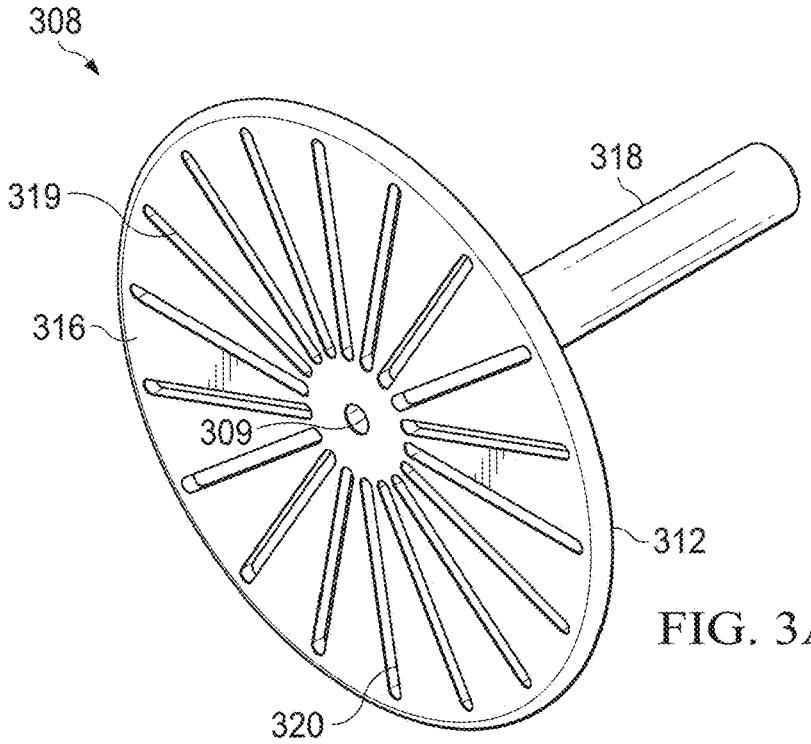
FIG. 3A is a perspective view of an example electrode for a downhole pulsed-power drill bit.
Figure 3B:
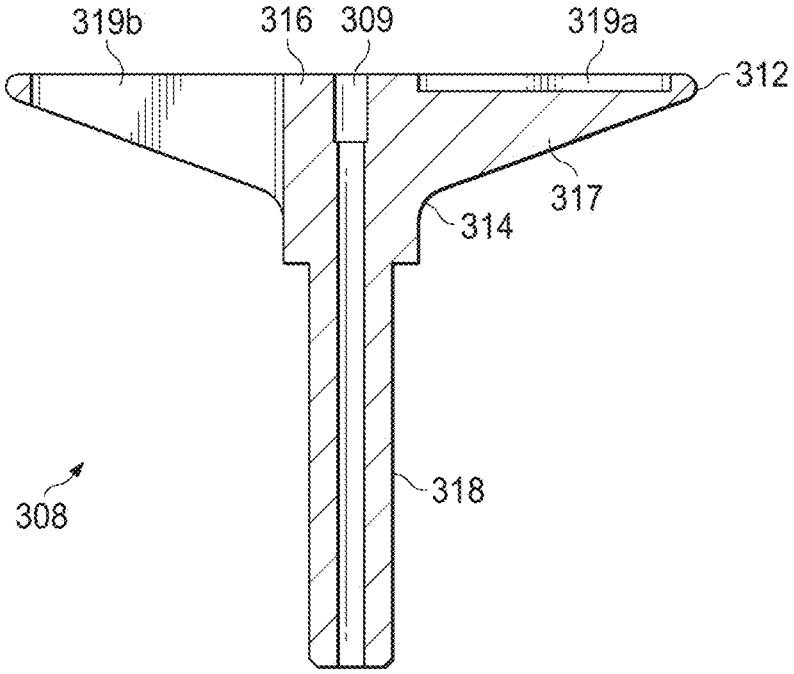
FIG. 3B is a cross-sectional view of the electrode shown in FIG. 3A.

FIG. 3A is a perspective view of an exemplary electrode for a downhole pulsed-power drill bit. FIG. 3B is a cross-sectional view of the electrode shown in FIG. 3A. Electrode 308 provides a similar function and has similar features as electrode 208 shown in FIG. 2.

High electrical energy pulses from a power source may be applied to electrode 308 to generate an arc as described in more detail in FIGS. 1 and 2. As described with reference to FIG. 2, the contours of the transitions between parts of electrode 308 affect the electric field surrounding the pulsed-power drill bit. For example, the transition between face 316 and body 317, edge 312, may have a sharp radius of curvature, as described above with reference to FIG. 2, such that the electric field conditions are favorable for an arc to initiate and/or terminate at edge 312. In contrast, transition 314, between body 317 and stem 318, may have a gentle radius of curvature such that the electric field conditions are not favorable for arc initiation and/or termination.

Electrode 308 may further include fluid flow opening 309 extending through stem 318 and body 317 to face 316 to direct pulsed-power drilling fluids from a drill string, such as drill string 108 shown in FIG. 1, downhole to the pulsed-power drilling bit. For example, the pulsed-power drill bit may be coupled to the drill string and pulsed-power drilling fluid may flow downhole through the drill sting, to pulsed-power drill bit and exit through fluid flow opening 309. A portion or all of the fluid flowing through the drill string may exit through fluid flow opening 309. Fluid flow opening 309 may be centered on face 316, as shown in FIGS. 3A and 3B, or may be offset radially. The flow path may be coaxial with electrode 308 or may be at an angle offset from the centerline of electrode 308. Fluid flow opening 309 may have a cross sectional area designed to result in higher fluid velocity than the flow through the drill string, and may include an orifice or jet.

Alternatively, fluid flow opening 309 may be used to accept a bolt to attach electrode 308 to the internal structure of the BHA (not expressly shown) to which electrode 308 is attached. Electrode 308 may further include slots 319 that facilitate the flow of pulsed-power drilling fluids around electrode 308. The presence of slots 319 may modify the direction and/or velocity of the flow of pulsed-power drilling fluid through the drilling area. Some slots 319 may be channels on face 316 of electrode 308, as shown by slot 319*a* in FIG. 3B, that extends partially through body 317. Other slots 319 may extend through body 317, as shown by slot 319*b* in FIG. 3B. Some or all slots 319 may terminate short of intersecting with fluid flow opening 309, as shown in FIGS. 3A and 3B and some or all slots 319 may intersect with fluid flow opening 309. Electrode 308 may have any combination of slots 319. As shown in FIG. 3A, edge 320 of each slot 319 may have a sharp radius of curvature, as described above with reference to FIG. 2, to create favorable conditions in the electric field for arc initiation and/or termination. Edge 320 of each slot 319 may also have a sharp radius or any other radius of curvature suitable for the drilling and/or fabrication process.

Electrode 308 may be manufactured from any material that can withstand the conditions in a wellbore and has sufficient conductivity to conduct thousands of amps per pulse without structurally damaging the electrode. Suitable materials include steel in the 41 family (often designated as the 41xx family, for example 4140 steel), carbon alloyed steel, stainless steel, nickel and nickel alloys, copper and copper alloys, titanium and titanium alloys, chromium and chromium alloys, molybdenum and molybdenum alloys, doped ceramics, composite materials using a matrix material having a high melting point, such as tungsten and a reinforcement material having a high conductivity and low melting point, such as copper, brass, silver, or gold, and combinations thereof. The conductivity of electrode 308 may be a function of the geometry of electrode 308 and the shape of the arc that forms between electrode 308 and the ground ring or other electrodes on the pulsed-power drilling bit. For example, the minimum conductivity of electrode 308 may be based on the voltage requirements of the pulsed-power drilling operation and such conductivities (measured at 20° C.) may be at least 0.5×10^6 l/ohm-meter, at least 1.0×10^7 l/ohm-meter, or higher. When an arc initiates or terminates at electrode 308, the temperature at the initiation or termination point increases such that the temperature melts the surface of electrode 308. Arc creation is often accompanied by a shock wave. When the shock wave impacts the melted surface of electrode 308, a portion of the melted surface may separate from the remainder of electrode 308 and be carried uphole with the pulsed-power drilling fluid. Therefore, to prevent material loss, the areas of electrode 308, for example edges 312 and/or 320, having electric field conditions favorable to arc initiation and/or termination may be coated with or made of a metal matrix composite. The metal matrix composite may be formed of a matrix material having a high melting point, and/or high resistance to electrical erosion, such as tungsten, carbide, ceramic, polycrystalline diamond compact, carbon fiber, graphene, graphite, olivene ($FEPO_4$), carbon tubes or combinations thereof, infused with a metal having a lower melting point, such as copper, gold, silver, indium, or combinations thereof. For example, the metal matrix composite may be a tungsten and copper composite such as ELKONITE®, manufactured and sold by CMW Inc. of Indianapolis, Ind. The melting point of the matrix material may be higher than the melting point of the infused metal. During arc initiation and/or termination, the infused metal may melt while the matrix material remains solid to hold the melted infused metal in place during the shock wave motion.

After the temperature decreases, the infused metal may solidify without substantial material loss, such as between 0.00001% and 1%, inclusive, or between 0.00001% and 0.1%, inclusive, material loss, of without any material loss.

Figure 4A:
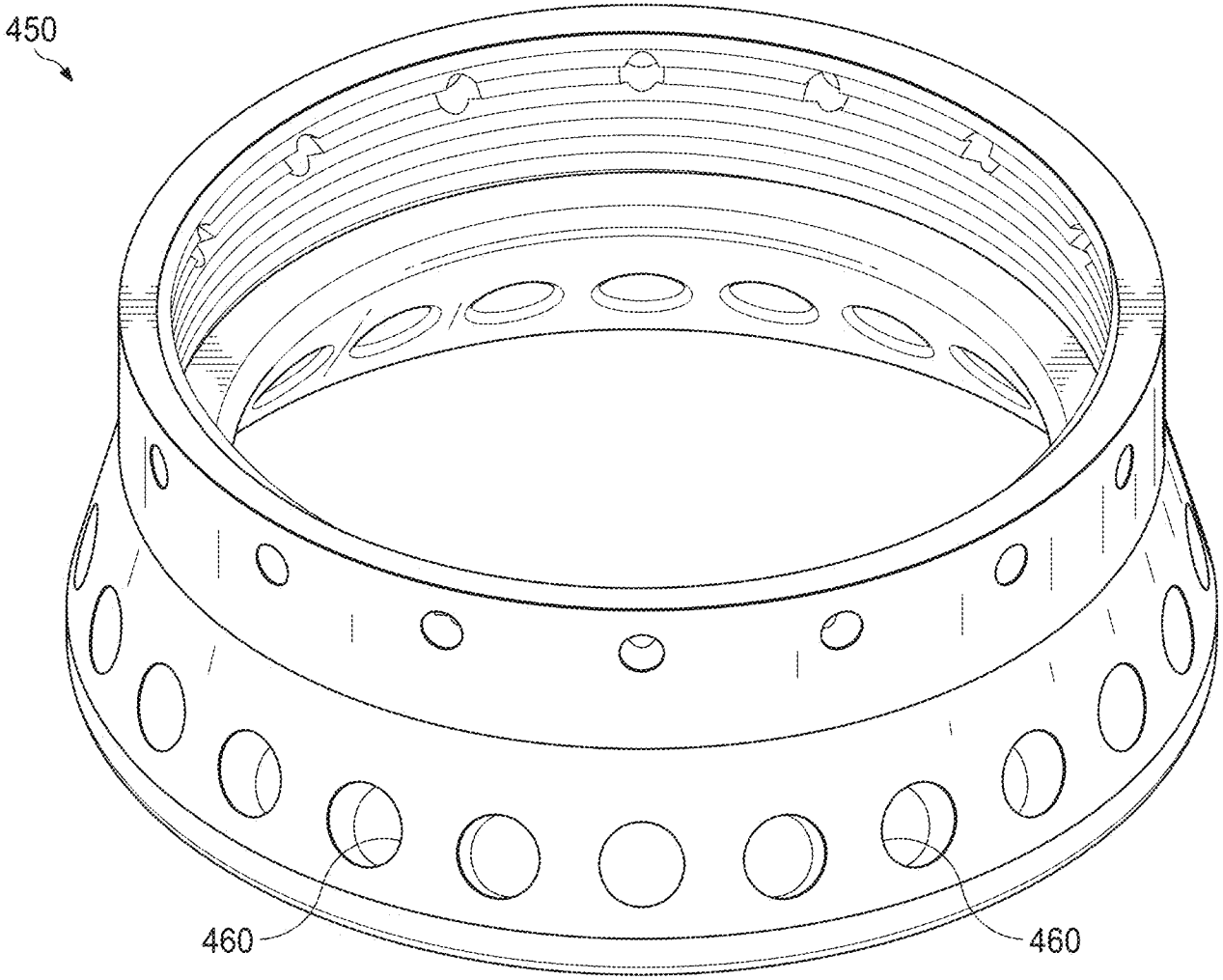
FIG. 4A is a perspective view of an example ground ring for a downhole pulsed-power drill bit.
Figure 4B:
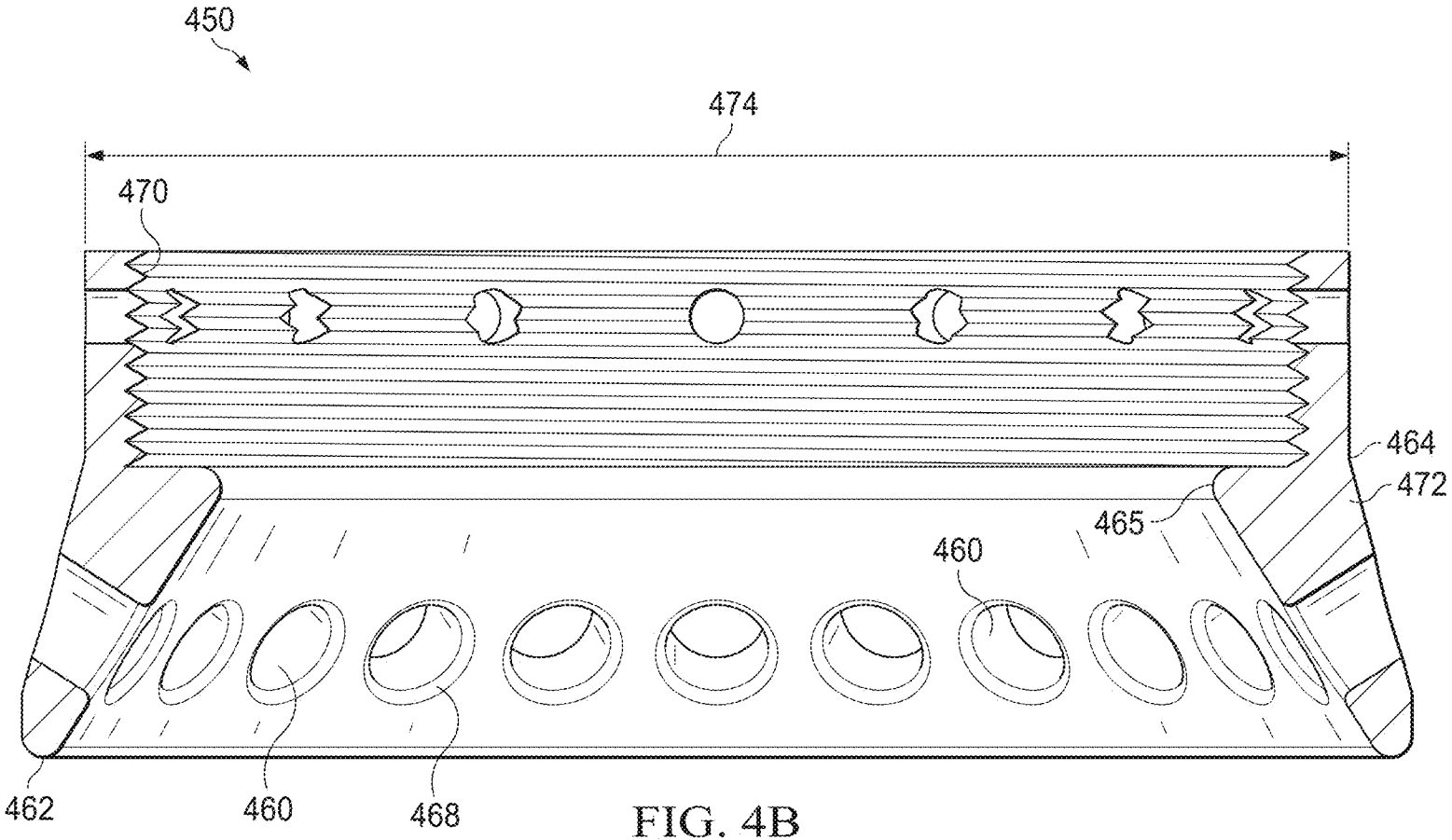
FIG. 4B is a cross-sectional view of the ground ring shown in FIG. 4A.

FIG. 4A is a perspective view of an exemplary ground ring for a downhole pulsed-power drill bit. FIG. 4B is a cross-sectional view of the ground ring shown in FIG. 4A. Ground ring 450 provides a similar function and has similar features as ground ring 250 shown in FIG. 2.

The shape of ground ring 450 may be selected to change the shape of the electric field surrounding the pulsed-power drill bit during pulsed-power drilling. For example, the electric field surrounding the pulsed-power drill bit may be designed so that the arc initiates at an electrode and terminates on ground ring 450 or vice versa such that the arc initiates from ground ring 450 and terminates on the electrode. The electric field changes based on the shape of the contours of the edges of ground ring 450. For example, downhole edge 462 may have a sharp radius of curvature such that the electric field conditions at downhole edge 462 are favorable for arc initiation and/or termination. Additionally, downhole edge 462 may be a distal portion of ground ring 450 that engages with a portion of the wellbore, such as wellbore 116 shown in FIG. 1. Curve 465 on the inner perimeter of ground ring 450 may have a gentle radius of curvature to such that the electric field conditions at curve 465 are not favorable for arc initiation and/or termination. A radius of curvature of a transition is the radius of a circle of which the arc of the transition is a part. By way of example, a sharp radius of curvature may be a radius in the range of between 0.05 to 0.15 inches, inclusive, such as 0.094 inches, and a gentle radius of curvature may be a radius in the range of between 0.20 to 1.0 inches, inclusive, or such as between 0.20 and 5.0 inches, inclusive, or 1.0 inches, 0.25 inches, 0.5 inches, 0.75 inches, or 1.0 inches. The gentle radius may be determined based on the geometry of the surrounding structures on pulsed-power drill bit 114 and the shape electric field for a given pulsed-power drilling operation. For example, the electric fields on electrode 208 may be a function of the geometry of ground ring 250 and the geometry and material of insulator 210. For example, the radius of the edge of electrode 208 and the shape of electrode 208 may affect the interaction of pulsed-power drill bit 114 with the rock. Additionally, the structure of ground ring 250 may be adjusted to change the electric field distribution on electrode 208. Further, the material used to form insulator 210 and the configuration of insulator 210 may be adjusted to change the electric field on electrode 208. In some examples, the dielectric constant of the pulsed-power drilling fluid and the geometry of the rock fragments and the wellbore during the drilling process may affect the instantaneous electric field distribution on electrode 208. The features on ground ring 450 having a sharp radius of curvature may have the same or different sharp radius as features on the electrode having a sharp radius of curvature.

Ground ring 450 may include one or more fluid flow ports 460 on the outer perimeter of ground ring 450 to direct pulsed-power drilling fluid from around an electrode, out of the drilling field, and uphole to clear debris from the pulsed-power drilling field. The number and placement of fluid flow ports 460 may be determined based on the flow requirements of the pulsed-power drilling operation. For example, the number and/or size of fluid flow ports 460 may be increased to provide a faster fluid flow rate and/or larger fluid flow volume. Edge 468 of each fluid flow port 460 may have a gentle radius of curvature such that the electric field conditions at edge 468 of each fluid flow port 460 are not favorable for arc initiation and/or termination.

In some examples, when an arc initiates or terminates at ground ring 450, the temperature at the initiation or termination point increases such that the temperature melts the surface of ground ring 450. When the shock wave hits the melted surface of ground ring 450, a portion of the melted surface may separate from the remainder of ground ring 450 and be carried uphole with the pulsed-power drilling fluid. Therefore, to prevent material loss, the areas of ground ring 450 having electric field conditions favorable to arc initiation and/or termination may be coated with or made from a metal matrix composite.

Ground ring 450 may further include threads 470 along the inner diameter of ground ring 450. Threads 470 may engage with corresponding threads on a portion of an pulsed-power drill bit such that ground ring 450 is replaceable during the pulsed-power drilling operation. Ground ring 450 may be replaced if ground ring 450 is damaged by erosion or fatigue during a pulsed-power drilling operation.

The thickness of wall 472 of ground ring 450 may be based on the diameter of ground ring 450 and/or the weight of the uphole components of the pulsed-power drilling system that are exerting downforce on ground ring 450. For example, the thickness of wall 472 may range from 0.25 inches to 2 inches, inclusive. The thickness of wall 472 may be based on the diameter of ground ring 450 such that the thickness of wall 472 increases as the diameter of ground ring 450 increases. Additionally, the thickness of wall 472 may taper such that the thickness is the smallest at downhole edge 462 and the largest between curve 464 and curve 465. For example, the thickness of wall 472 may be 0.3 inches at downhole edge 462 and increase to 0.8 inches between curve 464 and curve 465. The tapering of the thickness of wall 472 may provide annular clearance for the flow of pulsed-power drilling fluid to clear debris from between the bottom hole assembly to which the pulsed-power drill bit is attached and the inner wall of the wellbore.

Diameter 474 of ground ring 450 may be based on the diameter of the wellbore and the annular clearance between the wellbore and the bottom hole assembly to which the pulsed-power drill bit is attached. The diameter of the electrode contained within ground ring 450 on the pulsed-power drill bit may be selected for drilling a particular type of formation. For example, the diameter of the electrode may be selected to optimize the electric field surrounding the pulsed-power drill bit and provide flow space for pulsed-power drilling fluid. Ground ring 450 may have an outer diameter equal to the gauge of the wellbore to be drilled by the pulsed-power drill bit or may have an outer diameter slightly smaller than the gauge of the wellbore to be drilled. For example, the outer diameter of ground ring 450 may be at least 0.03 inches, inclusive, or at least 0.5 inches, inclusive smaller than the gauge of the wellbore to be drilled. In some examples, ground ring 450 may have features on the inner diameter of ground ring 450, such as curve 465, may have a gentle radius while features on the outer diameter of ground ring 450, such as curve 464, may have a sharp radius such that the pulsed-power drill bit creates an overgauged wellbore during a drilling operation.

During the pulsed-power drilling operation, the electrode and ground ring 450 may have opposite polarities to create electric field conditions such that arcs initiate at the electrode and terminate on the ground ring or vice versa such that the arcs initiate at ground ring 450 and terminate on the electrode. For example, the electrode may have a positive polarity while ground ring 450 has a negative polarity.

Figure 5:
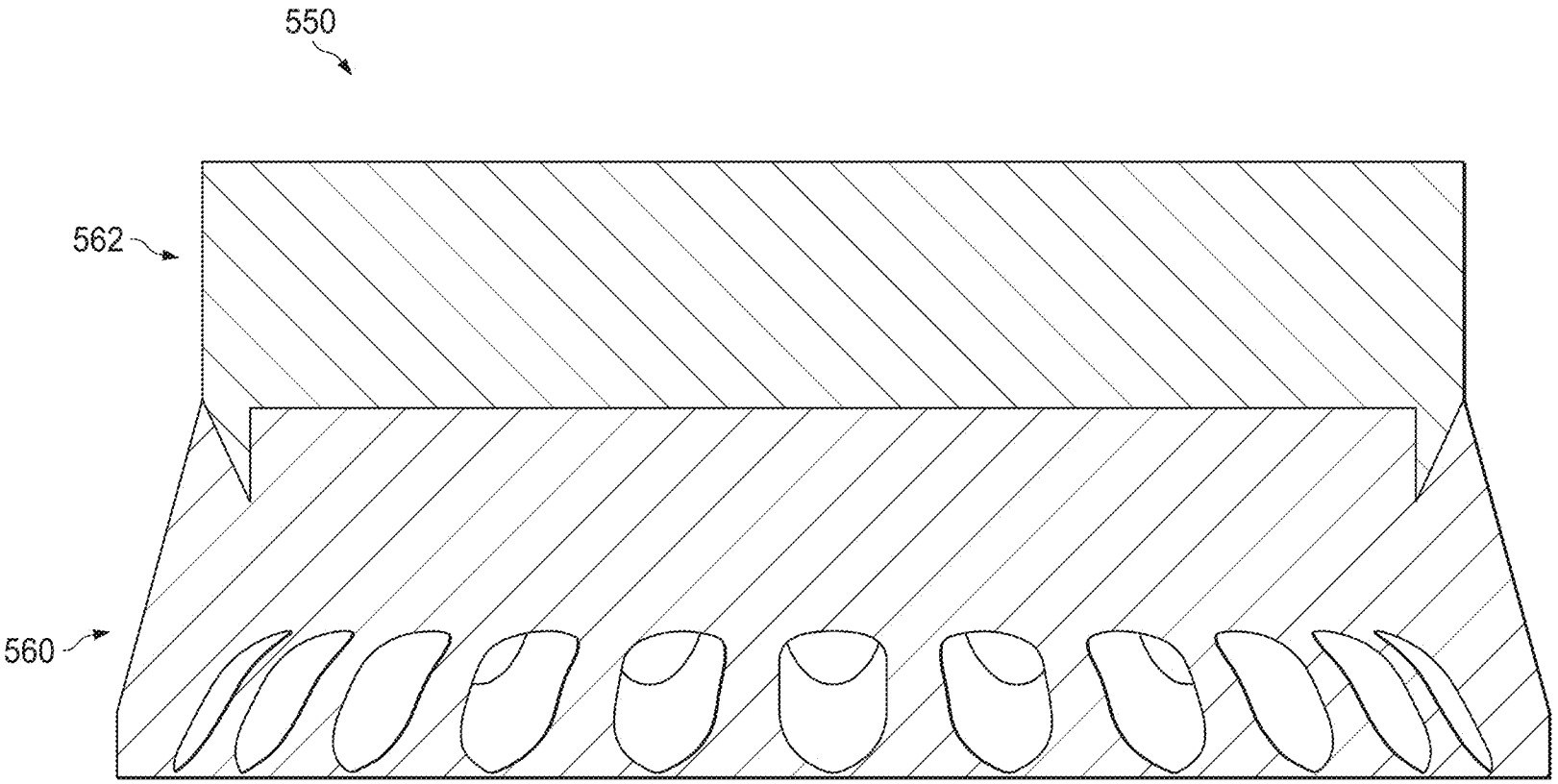
FIG. 5 is a cross-sectional view of an example ground ring for a downhole pulsed-power drill bit.

FIG. 5 is a perspective view of an exemplary ground ring for a downhole pulsed-power drill bit. Ground ring 550 provides a similar function and has similar features as ground ring 250 shown in FIG. 2, and ground ring 450 shown in FIGS. 4A and 4B. The ground ring 550 can include a metal-matrix composite (MMC). That is, the ground ring 550 can be formed by placing loose reinforcement material, e.g., in powder form, into a mold and infiltrating the reinforcement material with a binder material. The reinforcement material infiltrated with a molten metal alloy or binder material may form the ground ring 550 after solidification of the binder material with the reinforcement material.

For example, the ground ring 550 (and drill bit 114) may be formed by placing loose reinforcement material including tungsten carbide powder, into a mold and infiltrating the reinforcement material with a binder material including a copper alloy and/or an aluminum alloy. The mold may be formed by milling a block of material, such as graphite, to define a mold cavity having features that correspond generally with the exterior features of the ground ring 550 (and the drill bit 114).

Ground ring 550 may include a first portion, 560, and a second portion, 562, made of different materials.

The first portion, 560, may include a composite material including a reinforcement material and a binder material infiltrated through the reinforcement material. The reinforcement material can provide characteristics to the ground ring 550 (and the drill bit 114), such as fracture resistance, toughness, and/or resistance to abrasion (including erosion resistance, abrasion resistance, and wear resistance. The reinforcement material may be any suitable material, such as particles of metals, metal alloys, superalloys, intermetallics, borides, carbides, nitrides, oxides, silicides, ceramics, diamonds, and the like, or any combinations thereof. The reinforcement material may be in the form of particles, including coated particles.

More particularly, reinforcement material may include tungsten, molybdenum, niobium, tantalum, rhenium, iridium, ruthenium, beryllium, titanium, chromium, rhodium, iron, cobalt, nickel, nitrides, silicon nitrides, boron nitrides, cubic boron nitrides, natural diamonds, synthetic diamonds, cemented carbide, spherical carbides, low-alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, cobalt alloys, chromium alloys, HASTELLOY® alloys (e.g., nickel-chromium containing alloys, available from Haynes International), INCONEL® alloys (e.g., austenitic nickel-chromium containing superalloys available from Special Metals Corporation), WASPALOYS® (e.g., austenitic nickel-based superalloys), RENE® alloys (e.g., nickel-chromium containing alloys available from Altemp Alloys, Inc.), HAYNES® alloys (e.g., nickel-chromium containing superalloys available from Haynes International), INCOLOY® alloys (e.g., iron-nickel containing superalloys available from Mega Mex), MP98T (e.g., a nickel-copper-chromium superalloy available from SPS Technologies), TMS alloys, CMSX® alloys (e.g., nickel-based superalloys available from C-M Group), cobalt alloy 6B (e.g., cobalt-based superalloy available from HPA), N-155 alloys, any mixture thereof, and any combinations thereof. In some examples, multiple different types of reinforcement material may be used to form the ground ring 550, and in particular the first portion 560 of the ground 550.

In some examples, the binder material can include any suitable binder material such as copper, nickel, cobalt, iron, aluminum, molybdenum, chromium, manganese, tin, zinc, lead, silicon, tungsten, boron, phosphorous, gold, silver, palladium, indium, and/or alloys thereof, and combinations thereof. In some examples, the binder material may have a critical temperature or melting point higher than the expected temperatures during PPD. In some examples, the composite material can have a first resistance to abrasion, such as a first erosion resistance, a first abrasion resistance, or a first wear resistance, a first fracture resistance, and a first toughness.

Second portion 562 of the ground ring 550 may be formed from a machinable material having a composition different than the composite material. The second portion 562 of the ground ring 550 is positioned between the first portion 560 of the ground ring and the bit body (e.g., the bit body 255). Machining of the machinable material may be useful for such applications as formation of holes, threads, and other connections within the ground ring 550. The machinable material may have properties that minimize cracking or failure under extreme stress. The machinable material may have a second resistance to abrasion, such as a second erosion resistance, a second abrasion resistance, or a second wear resistance, a second fracture resistance, and a second toughness.

The first resistance to abrasion of the composite material of the first portion 560 of the ground ring 550 may be greater than the second resistance to abrasion of the machinable material of the second portion 562 of the ground ring 550. The first fracture resistance of the first portion 560 of the ground ring 550 may be greater than the second fracture resistance of the machinable material of the second portion 562 of the ground ring 550. The first toughness of the first portion 560 of the ground ring 550 may be greater than the second toughness of the second portion 562 of the ground ring 550.

It is understood that, in order to facilitate attachment of the first portion and the second portion, there may be an intermediate region in which the materials of the first portion and the second portion are mixed. Such intermediate region should not be considered part of the first portion or the second portion. This intermediate region may be small, spanning a distance between the first portion and second portion of 1 inch or less, 0.5 inches or less, or 0.1 inches or less.

In some examples, the machinable material may have the same composition as the binder material or may include binder material. The second portion 562 of the ground ring 550 may include between 50% and 99.5% or 100%, inclusive, of between 95% and 99.5% or 100%, inclusive, binder material, in combination with an additional material. Typically the additional material does not have the same composition as the reinforcement material.

In some examples, the machinable material is steel. In some examples, the second portion 562 of the ground ring 550 can include a steel blank. The steel of the second portion 562 of the ground ring 550 can include steel in the 41 family (often designated as the 41xx family, for example 4140 steel), carbon alloyed steel, and stainless steel.

In some examples, the second portion 562 of the ground ring 550 can include both steel and the binder material. In such cases, steel may function as the "additional material" as described above, or a different "additional material" combined with binder material may be present. For example, the second portion 562 of the ground ring 550 can alternate binder material portions and steel material regions. For example, there may be horizontally or vertically alternating regions. However, other combinational layouts of the binder material portions and the steel material portions of the second portion 562 of the ground ring 550 are possible based on the design requirements of the ground ring 550.

In some examples, the second portion 562 of the ground ring 550 may not include the reinforcement material. That is, the second portion 562 of the ground ring 550 does not include the reinforcement material; and only the first portion 560 of the ground ring 550 includes the reinforcement material. In some examples, the second portion 562 of the ground ring 550 includes a quantity of the reinforcement material below a threshold, such as less than 5%, 1%, or 0.5% or less, inclusive.

In some examples, a mold may be formed by milling a block of material, such as graphite, to define a mold cavity having features that correspond generally with the exterior features of the drill bit 114, including the ground ring 550. A quantity of the reinforcement material may be placed within the mold cavity and infiltrated with molten binder material to form at least the composite material and form the first portion 560 of the ground ring 550 after solidification of the binder material with the reinforcement material. In some examples, machinable binder material may be placed within the mold cavity to form the second portion 562 of the ground ring 550 absent of the reinforcement material.

In some examples, various features of the drill bit 114, including the ground ring 550, may be provided by shaping the mold cavity and/or by positioning temporary displacement elements within interior portions of the mold cavity. A preformed steel blank may be placed within the mold cavity to provide reinforcement for bit body 255 and to allow attachment of drill bit 114 with a drill string and/or BHA. In some examples, the steel blank can include the second portion 562 of the ground ring 550.

Figure 6:
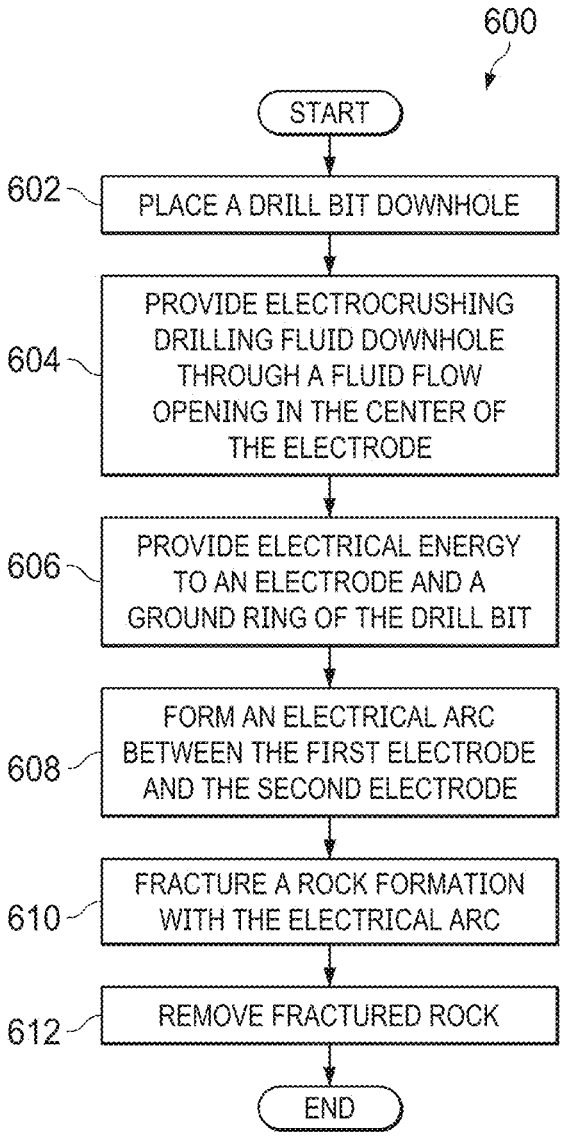
FIG. 6 is flow chart of an example method for drilling a wellbore.

FIG. 6 is a flow chart of exemplary method for drilling a wellbore. Method 600 may begin and at step 610 a drill bit may be placed downhole in a wellbore. For example, drill bit 114 may be placed downhole in wellbore 116 as shown in FIG. 1, including the ground ring 550 as shown in FIG. 5.

At step 620, pulsed-power drilling fluid may be provided to the downhole drilling field through a fluid flow opening in the center of the electrode, along with fluid flow over the top of the electrode. For example, as described above with reference to FIG. 3, an electrode may include a fluid flow opening in the center of the electrode. Pulsed-power drilling fluid may flow from the drill sting out of the fluid flow opening and into the drilling area. Once in the drilling area, the flow of the pulsed-power drilling fluid may be directed by one or more slots on the face of the electrode.

At step 630, electrical energy may be provided to an electrode and a ground ring of the drill bit. For example, as described above with reference to FIGS. 1 and 2, a pulse-generating circuit may be implemented within pulsed-power tool 230 of FIG. 2. And as described above with reference to FIG. 2, pulsed-power tool 230 may receive electrical power from a power source on the surface, from a power source located downhole, or from a combination of a power source on the surface and a power source located downhole. The electrical power may be provided to the pulse-generating circuit within pulse-power tool 230. The pulse generating circuit may be coupled to an electrode (such as electrode 208 shown in FIG. 2) and a ground ring (such as ground ring 550 shown in FIG. 5) of drill bit 114.

At step 640, an electrical arc may be formed between the first electrode and the second electrode of the drill bit. The pulse-generating circuit may be utilized to repeatedly apply a high electric potential, for example up to or exceeding 150 kV, across the electrode. Each application of electric potential may be referred to as a pulse. When the electric potential across the electrode and ground ring is increased enough during a pulse to generate a sufficiently high electric field, an electrical arc forms through a rock formation at the bottom of the wellbore. The arc may initiate at a portion of the electrode having a sharp radius of curvature and terminate on a portion of the ground ring having a sharp radius of curvature, or vice versa such that the arc initiates on a portion of the ground ring having a sharp radius of curvature and terminate on a portion of the electrode having a sharp radius of curvature. The arc temporarily forms an electrical coupling between the electrode and the ground ring, allowing electric current to flow through the arc inside a portion of the rock formation at the bottom of the wellbore.

At step 650, the rock formation at an end of the wellbore may be fractured by the electrical arc. For example, as described above with reference to FIGS. 1 and 2, the arc greatly increases the temperature of the portion of the rock formation through which the arc flows as well as the surrounding formation and materials. The temperature is sufficiently high to vaporize any water or other fluids that may be touching or near the arc and may also vaporize part of the rock formation itself. The vaporization process creates a high-pressure gas which expands and, in turn, fractures the surrounding rock.

At step 660, fractured rock may be removed from the end of the wellbore. For example, as described above with reference to FIG. 1, pulsed-power drilling fluid 122 may move the fractured rock away from the electrode and uphole away from the bottom of wellbore 116. The steps of method 600 may be repeated until the wellbore has been drilled or the drill bit needs to be replaced. Subsequently, method 600 may end.

Modifications, additions, or omissions may be made to method 600 without departing from the scope of the disclosure. For example, the order of the steps may be performed in a different manner than that described and some steps may be performed at the same time. Additionally, each individual step may include machinable steps without departing from the scope of the present disclosure.

A. A pulse-power drill bit, including a bit body; an electrode coupled to the bit body; and a ground ring coupled to the bit body proximate to the electrode and having a first portion and a second portion located between the first portion and the bit body, the first portion including a composite material including a reinforcement material and a binder material infiltrated through the reinforcement material, the second portion including a machinable material having a composition different than the composite material.

B. A downhole drilling system including a drill string; and a pulse-power drill bit coupled to the drill string, the drill bit including: a bit body; an electrode coupled to the bit body; and a ground ring coupled to the bit body proximate to the electrode and having a first portion and a second portion located between the first portion and the bit body, the first portion including a composite material including a reinforcement material and a binder material infiltrated through the reinforcement material, the second portion including a machinable material having a composition different than the composite material.

C. A method including placing a pulse-powered drill bit downhole in a wellbore, the drill bit including: a bit body;

an electrode coupled to a power source and the bit body; and a ground ring coupled to the bit body proximate to the electrode and having a first portion and a second portion located between the first portion and the bit body, the first portion including a composite material including a reinforcement material and a binder material infiltrated through the reinforcement material, the second portion including a machinable material having a composition different than the composite material; and conducting pulsed-power drilling using the drill bit.

The pulsed-power drilling system of Embodiment B may include a pulsed-power drill bit of Embodiment A. The pulsed-power drill bit of Embodiment A and the pulsed power-drilling system of Embodiment B may be operated according to the method of drilling a wellbore of Embodiment C. Each of embodiments A, B and C may have one or more of the following machinable elements in any combination unless clearly mutually exclusive:

Element 1: wherein the composite material has a first resistance to abrasion, a first fracture resistance, and a first toughness, the machinable material has a second resistance to abrasion, a second fracture resistance, and a second toughness, and at least one of the first resistance to abrasion, first fracture resistance, or first toughness is greater than the second resistance to abrasion, second fracture resistance, or second toughness; Element 2: wherein the machinable material has the same composition as the binder material infiltrated through the reinforcement material; Element 3: wherein the machinable material further includes an additional material; Element 4: wherein the machinable material further includes steel; Element 5: wherein the machinable material includes steel; Element 6: wherein the second portion of the ground ring does not include the reinforcement material.

Although the present disclosure has been described with several embodiments, various changes and modifications may be suggested to one skilled in the art. It is intended that the present disclosure encompasses such various changes and modifications as falling within the scope of the appended claims.

What is claimed is:

1. A pulse-power drill bit, comprising:
- a bit body;
- an electrode coupled to the bit body; and
- a ground ring coupled to the bit body proximate to the electrode, the ground ring including:
  - a defined first portion, the first portion including i) a composite material that includes a reinforcement material and a binder material infiltrated through the reinforcement material and ii) one or more flow ports formed from the composite material; and
  - a defined second portion mechanically coupled adjacent the first portion and located between the first portion and the bit body, the second portion including a machinable material having a composition different than the composite material of the first portion.

2. The pulse-power drill bit of claim 1, wherein the composite material has a first resistance to abrasion, a first fracture resistance, and a first toughness, the machinable material has a second resistance to abrasion, a second fracture resistance, and a second toughness, and at least one of the first resistance to abrasion, first fracture resistance, or first toughness is greater than the second resistance to abrasion, second fracture resistance, or second toughness.

3. The pulse-power drill bit of claim 1, wherein the machinable material has the same composition as the binder material infiltrated through the reinforcement material.

4. The pulse-power drill bit of claim 3, wherein the machinable material further includes an additional material.

5. The pulse-power drill bit of claim 3, wherein the machinable material further includes steel.

6. The pulse-power drill bit of claim 1, wherein the machinable material includes steel.

7. The pulse-power drill bit of claim 1, wherein only the first portion of the ground ring includes the reinforcement material.

8. A downhole drilling system, comprising:
- a drill string; and
- a pulse-power drill bit coupled to the drill string, the drill bit including:
  - a bit body;
  - an electrode coupled to the bit body; and
- a ground ring coupled to the bit body proximate to the electrode, the ground ring including:
  - a defined first portion and a second portion located between the first portion and the bit body, the first portion including i) a composite material that includes a reinforcement material and a binder material infiltrated through the reinforcement material and ii) one or more flow ports formed from the composite material;
  - a defined second portion mechanically coupled adjacent the first portion and located between the first portion and the bit body, the second portion including a machinable material having a composition different than the composite material.

9. The downhole drilling system of claim 8, wherein the composite material has a first resistance to abrasion, a first fracture resistance, and a first toughness, the machinable material has a second resistance to abrasion, a second fracture resistance, and a second toughness, and at least one of the first resistance to abrasion, first fracture resistance, or first toughness is greater than the second resistance to abrasion, second fracture resistance, or second toughness.

10. The downhole drilling system of claim 8, wherein the machinable material has the same composition as the binder material infiltrated through the reinforcement material.

11. The downhole drilling system of claim 10, wherein the machinable material further includes an additional material.

12. The downhole drilling system of claim 10, wherein the machinable material further includes steel.

13. The downhole drilling system of claim 8, wherein the machinable material includes steel.

14. The downhole drilling system of claim 8, wherein only the first portion of the ground ring includes the reinforcement material.

15. A method, comprising:
- placing a pulse-powered drill bit downhole in a wellbore, the drill bit including:
- a bit body;
- an electrode coupled to the bit body;
- a ground ring coupled to the bit body proximate to the electrode, the ground ring including:
  - a defined first portion and a second portion located between the first portion and the bit body, the first portion including i) a composite material that includes a reinforcement material and a binder material infiltrated through the reinforcement material and ii) one or more flow ports formed from the composite material; and
  - a defined second portion mechanically coupled adjacent the first portion and located between the first portion and the bit body, the second portion including a machinable material having a composition different than the composite material; and conducting pulsed-power drilling using the drill bit.

16. The method of claim 15, wherein the composite material has a first resistance to abrasion, a first fracture resistance, and a first toughness, the machinable material has a second resistance to abrasion, a second fracture resistance, and a second toughness, and at least one of the first resistance to abrasion, first fracture resistance, or first toughness is greater than the second resistance to abrasion, second fracture resistance, or second toughness.

17. The method of claim 15, wherein the machinable material has the same composition as the binder material infiltrated through the reinforcement material.

18. The method of claim 17, wherein the machinable material further includes an additional material.

19. The method of claim 15, wherein the machinable material includes steel.

20. The method of claim 15, wherein only the first portion of the ground ring includes the reinforcement material.

* * * * *